US005384232A

United States Patent [19]

Bishop et al.

[11] Patent Number: 5,384,232

[45] Date of Patent: Jan. 24, 1995

[54] PROCESS FOR RAPID ACCESS DEVELOPMENT OF SILVER HALIDE FILMS USING PYRIDINIUM AS DEVELOPMENT ACCELERATORS

[75] Inventors: Julie C. Bishop, Old Bridge, N.J.; Dominic M. Chan, Wilmington, Del.; Dennis S. Donald, Mendenhall, Pa.; Ludovic Fodor, Monmouth Junction, N.J.; William R. Pangratz, Middletown, N.J.; Glenn M. Russo, Mullica Hill, N.J.; John R. Shock, Princeton Junction, N.J.

[73] Assignee: E. I. Du Pont de Nemours and Company, Wilmington, Del.

[21] Appl. No.: 40,247

[22] Filed: Mar. 30, 1993

Related U.S. Application Data

[63] Continuation-in-part of Ser. No. 801,347, Dec. 2, 1991, abandoned.

[51] Int. Cl.[6] ..... G03C 5/18; G03C 5/26

[52] U.S. Cl. ..... 430/440; 430/446; 430/480; 430/483; 430/485; 430/487; 430/963

[58] Field of Search ..... 430/264, 442, 469, 487, 430/564, 963, 436, 438, 440, 481, 483, 485, 478, 598, 604, 605, 480, 484, 435, 448, 446

[56] References Cited

U.S. PATENT DOCUMENTS

| | | | |
|---|---|---|---|
| 2,410,690 | 11/1946 | Smith et al. | 95/6 |
| 2,648,604 | 8/1953 | Welliver et al. | 430/487 |
| 2,685,514 | 8/1954 | Haist et al. | 430/409 |
| 2,688,548 | 9/1954 | Reynolds | 430/480 |
| 2,688,549 | 9/1954 | James et al. | 430/465 |
| 2,950,970 | 8/1960 | Schwan et al. | 430/469 |
| 3,129,097 | 4/1964 | van Hoof et al. | 430/487 |
| 3,212,899 | 10/1965 | Kennard et al. | 430/564 |
| 3,337,342 | 8/1967 | Green | 430/483 |
| 3,532,499 | 10/1970 | Willems et al. | 430/564 |
| 3,682,634 | 8/1972 | Willems | 430/484 |
| 3,705,806 | 12/1972 | Sykes et al. | 430/484 |
| 3,713,827 | 1/1973 | Willems | 430/484 |
| 3,870,479 | 3/1975 | Kubotera et al. | 430/478 |
| 3,893,862 | 7/1975 | Munshi et al. | 430/487 |
| 4,095,982 | 6/1978 | Yoneyama et al. | 96/50 PT |
| 4,269,929 | 5/1929 | Nothnagle | 430/264 |
| 4,324,855 | 4/1982 | Oishi et al. | 430/598 |
| 4,486,528 | 12/1984 | Morigaki et al. | 430/218 |
| 4,803,149 | 2/1989 | Takahashi et al. | 430/264 |
| 4,828,968 | 5/1989 | Okutsu | 430/264 |
| 4,839,258 | 6/1989 | Katoh | 430/264 |
| 4,851,321 | 7/1989 | Takagi et al. | 430/264 |
| 4,880,729 | 11/1989 | Heki et al. | 430/410 |
| 4,937,160 | 6/1990 | Rüger | 430/441 |
| 4,965,169 | 10/1990 | Hirano et al. | 430/264 |
| 5,098,819 | 3/1992 | Knapp | 430/436 |
| 5,104,769 | 4/1992 | Looker et al. | 430/264 |
| 5,147,756 | 9/1992 | Foder | 430/598 |
| 5,147,767 | 9/1992 | Knapp | 430/268 |
| 5,190,847 | 3/1993 | Chan et al. | 430/598 |
| 5,196,298 | 3/1993 | Meens et al. | 430/446 |
| 5,236,816 | 8/1993 | Purol et al. | 430/492 |
| 5,264,323 | 11/1993 | Purol et al. | 430/264 |
| 5,278,035 | 1/1994 | Knapp | 430/436 |
| 5,316,890 | 5/1994 | Okamura et al. | 430/264 |

FOREIGN PATENT DOCUMENTS

| | | |
|---|---|---|
| 2049253 | 8/1991 | Canada . |
| 0254195 | 7/1987 | European Pat. Off. . |
| 7126462 | 7/1971 | France . |
| 2647940 | 10/1976 | Germany . |

*Primary Examiner*—Charles L. Bowers, Jr.
*Assistant Examiner*—J. Pasterczyk

[57] ABSTRACT

A process of developing exposed silver halide elements comprises developing said element in a developer in the presence of a development accelerator compound as defined. The development accelerator compounds include pyridinium, or pyridinium and and imidazolium compounds. The process is applicable to standard and hydrazine-containing films and to hydroquinone and/or ascorbic acid-based developers. The development accelerator may be incorporated into the developer or into the silver halide emulsion.

15 Claims, No Drawings

PROCESS FOR RAPID ACCESS DEVELOPMENT OF SILVER HALIDE FILMS USING PYRIDINIUM AS DEVELOPMENT ACCELERATORS

CROSS-REFERENCE TO RELATED APPLICATIONS

This application is a continuation-in-part of U.S. Ser. No. 07/801,347, filed Dec. 2, 1991, now abandoned in favor of this application.

BACKGROUND OF THE INVENTION

1. Field of the Invention

This invention relates to the field of photographic silver halide systems and more specifically to the processing of photographic silver halide elements.

2. Description of the Prior Art

Photographic silver halide elements have long been used to record images and are often preferred because they have excellent image reproduction characteristics and high speed. In the field of lithography, a host of varied silver halide elements have been described for this method of reproduction, most of which have the high contrast and density needed to produce the good half-tone dots necessary for this reproduction method. However, most of these elements require a so-called "induction period" during development, which means that there is an initial lag period during which processing is relatively slow prior to infectious development when the high contrast and density are achieved.

In an on-going effort to reduce or eliminate the induction period and thereby make a so-called "rapid access system," it has been observed that rapid access can be achieved, for example, by the addition of hydrazines and derivatives thereof to either the silver halide emulsion or to the developing solutions. It has been preferable to add the hydrazine compounds to the emulsion, however, since the processing thereof can be better controlled. Research Disclosure 23510 (November 1983) presents a summary of the extensive literature on this subject.

Although the use of hydrazine compounds reduced or eliminated the induction period, these systems resulted in a loss of image quality such as lower dot quality, or the image may have a spotted appearance, or so-called "pepper." This is extremely undesirable and there have been numerous attempts in the prior art to reduce the propensity of the hydrazine-containing rapid access lithographic systems to produce pepper.

The developing solutions for elements containing hydrazine compounds typically contain conventional silver halide developing agents such as hydroquinone or derivatives thereof. It is typically necessary to add a super-additive developing agent such as phenidone or metol, for example. These developing solutions are necessarily kept at a fairly high pH which is deleterious to the life expectancy of the solution itself and to the processing equipment. Additionally, these prior art developing solutions tend to be environmentally hazardous and will produce sludge in the developing tanks.

Rüger, U.S. Pat. No. 4,937,160 teaches a novel group of hydrazides which can be used in a manner similar to the prior art hydrazines, but with the advantage of somewhat lower processing pH. Silver halide elements containing these novel hydrazides, however, also suffer from the other disadvantages noted above, such as the appearance of "pepper" and the relative toxicity of the developer solutions. Thus, a more stable processing solution with an even lower pH and a shortened development time has long been sought after by the prior art.

The use of ascorbic acid or its derivatives as developing agents for silver halide elements is known in the prior art. For example, James, J., Amer. Chem. Soc., Jan. 1944 (Communication No. 951 from the Kodak Research Laboratories) states that ascorbic and isoascorbic acid can be used as developing agents for silver halide elements. Similarly, U.S. Pat. No. 2,688,549 teaches the use of a developer solution comprising 3-pyrazolidone and ascorbic acid or its sugar analogs. However, these prior art developing solutions were very slow and found little or no commercial success.

Recently, because ascorbic acid and its derivatives are environmentally safer than hydroquinone, there have been attempts to enhance conventional developing solutions by substituting ascorbic acid or erythorbic acid together with salts thereof for hydroquinone. For example, U.S. Pat. No. 5,098,819 discloses a hydroquinone-free and alkali metal hydroxide-free developer solution wherein the developing agent consists of a salt of ascorbic or erythorbic acid either alone or in combination with ascorbic or erythorbic acid. In addition to the environmental advantage of removing hydroquinone from the developer solution, these developing agents are also advantageous because they tend to reduce the sludge commonly found in the developing tanks.

However, a shortcoming of the aforementioned ascorbate-containing developer solutions is that their slow development time make them unsatisfactory for use with rapid access processing, particularly with hydrazine-containing films. The prior art ascorbate developer solutions are much lower in pH (e.g., 9.7–10) and are not formulated for the rapid access processing of hydrazine films. Even if the pH is increased, these ascorbate-containing developers will provide unsatisfactory results.

In the general field of silver halide development and processing it has been conventional to try and improve or accelerate the over-all process. Some of the prior art mentions that so-called polyethylene oxides have been used successfully to achieve this acceleration. Additionally, Haist et al., U.S. Pat. No. 2,685,514, describes and claims the use of certain quaternary ammonium compounds, including 1-$\beta$-phenethyl-g-picolinium bromide, to increase the activity of hydrazine-containing developer solutions for direct positive elements. (Direct positive elements are those in which an internal latent image has already been formed.) The hydrazine compounds described by Haist et al. are not similar to those currently used in rapid access, negative-working silver halide elements and, although Haist et al. states that these hydrazine compounds could be incorporated into the emulsion, it was not conventional to do so at that time. Indeed, the Examples and the claims of Haist et al. are specifically limited to developer solutions containing hydrazines. Additionally, the development times for the elements in Haist et al. are all over 1 minute, mostly 2–3 minutes, which is commercially unacceptable for the rapid access systems of today.

SUMMARY OF THE INVENTION

Accordingly, it is an object of the invention to provide a process for developing exposed silver halide photographic elements comprising developing said elements in a photographic developer in the presence of a development accelerator having the general formula:

$$(A—(CH_2)_m—(Y)_n—(Z)k—(CH_2)_p—B)\ qX$$

wherein

A is

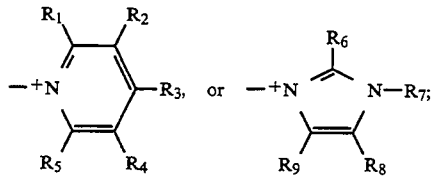

B is selected from the group consisting of A, hydrogen, phenyl, sulfonate, protonated substituted amino groups, unprotonated substituted amino groups, protonated unsubstituted amino groups, and unprotonated unsubstituted amino groups.

Y is a carbonyl-containing linkage;

Z is phenyl;

m is an integer from 0 to 8;

p is an integer from 0 to 8;

k is 0 or 1;

n is 0or 1;

with the proviso that m+n+p+k is greater than 0, and further with the proviso that when n is 1, m is greater than 0 and k+p is greater than 0;

$R_1$ through $R_9$ are independently selected from the group consisting of hydrogen, halogen, amino, saturated or unsaturated alkyl of 1 to 10 carbon atoms, wherein adjacent R groups can form a saturated or unsaturated ring;

X is a counterion and may be halide, or an organic ion; and q is an integer from 0 to 2 and is selected to balance the charge of the compound.

DETAILS OF THE INVENTION

Silver Halide Elements

Silver halide elements useful within the ambit of this invention comprise a gelatino silver halide emulsion coated on a support. The silver halide emulsions include any of the commonly available silver halides such as silver bromide, silver chloride, silver iodide or mixtures of two or more of these halide salts. These emulsions may be precipitated by any of the conventional and well-known techniques such as splash or balanced double jet, for example. A rhodium salt may be added during grain formation as is conventional in the art.

The so-called "bright-light" films may also be used to advantage in the present invention. Such films are well known in the art and are specifically formulated to be safely handled in UV filtered bright white room light. Such films typically comprise a high chloride content (at least about 90 mole % chloride) and are doped with at least about $10^{-6}$ mole of rhodium per mole of silver. It has been observed (as demonstrated in the Examples that follow) that the use of the development accelerators described herein in certain bright-light systems offers the advantage of increased contrast and image quality (i.e., dot quality) as well as the increase in development rate.

After precipitation of the grains in a small amount of gelatin, the grains are conventionally dispersed in a bulking amount of gelatin and sensitized with conventional chemical sensitizing agents, such as sulfur sensitizers, selenium sensitizers, noble metal sensitizers (e.g., gold salts) and reduction sensitizers, as is well-known to those of normal skill in the art. Sensitizing dyes, antifoggants, dispersing agents, coating aids and hardeners may also be added if desired.

Polyethylene terephthalate is the preferred support for the silver halide emulsions, which may be suitably subbed with resin and/or gelatin layers, as is conventional. Other useful supports such as cellulosic supports (e.g., cellulose acetate, etc.) and other common supports for the coating of silver halide elements which are well-known in the prior art may be used.

These emulsions may contain a hydrazine compound such as those previously described, with one of the hydrazides of the aforementioned Rûger, U.S. Pat. No. 4,937,160 preferably being used in accordance with the teachings of that patent. A most preferred silver halide emulsion for most graphic arts applications will comprise silver bromoiodide grains, wherein the iodide content ranges from 0 to about 2 mole %, and will contain 80 g of gelatin per mole of silver halide present. This emulsion will be sensitized with sodium thiosulfate and green sensitizing dye and will contain 250 mg of 2-(4-benzyloxyphenyl)-1-pyridinium acetyl-hydrazine bromide (BOP-HMP) per 1.5 moles of silver halide present. After full sensitization, standard antifoggants, coating aids, etc. are added and the emulsion coated on a 4 mil dimensionally stable, polyethylene terephthalate film support to about 4.4 g/m$^2$ coating weight.

For bright-light film applications, the preferred hydrazines are those taught in U.S. Pat. No. 5,190,847, most preferably a those having a cationic imidizolium moiety. Particularly preferred is a chloride or bromide salt of 1-[(4-benzyloxyphenylhydrazido)methyl]-imidazolium, taught in said reference as Compound II-39.

Developers

Developer solutions which may be used within the ambit of this invention include those commonly known in the lithographic and printing industry. Most of these are based on hydroquinone or a substituted hydroquinone (hereinafter referred to as "hydroquinone compounds") along with one or more super-additive developing agents. In addition to a hydroquinone compound, or as a substitute therefor, the developer solution may contain an ascorbic acid-type developing agent (hereinafter referred to as "ascorbic acid compounds") which may include ascorbic acid; derivatives thereof, such as D-and L-ascorbic acid, erythorbic acid (also known as iso-erythorbic acid), etc.; the alkali salts of either; and mixtures thereof, for example. In the preferred embodiment, a mixture of sodium L-ascorbate and L-ascorbic acid or sodium erythorbate is the developing agent and no hydroquinone compound is present in the developer solution. The preferred embodiment also contains a small amount of a super-additive developer, such as 1-phenyl-3-pyrazolidone or derivatives thereof, among others.

Other adjuvants usable in the developer solutions include antioxidants (e.g., alkali metal sulfites), sequestering agents (e.g., ethylenediaminetetraacetic acid, trisodium salt (Na3EDTA)), and the like. Buffers and pH adjusting compounds may also be mentioned here. Antifoggants and restrainers (KBr, Benzotriazole (BZT), 1-Phenyl-5-Mercaptotetrazole (PMT), etc.) may also be employed as is well known in the art.

If desired, the developer solutions of this invention may also contain other adjuvants to aid the development rate, such as alkanol amines and the aforementioned polyalkylene oxides, for example. Particularly preferred for use with the ascorbic acid compounds as developing agents are the alkanol amines of copending U.S. application Ser. No 07/801,346, filed Dec. 2, 1991, now abandoned, the disclosure of which is incorporated herein by reference. Most preferred is n-butyldiethanolamine because of its lower toxicity and less objectionable odor.

A typical and preferred developer solution of this invention will have the following composition:

| Ingredient | Amount (g) Range | Preferred |
|---|---|---|
| Sodium Erythorbate | 10–150 | 60 |
| $Na_3EDTA$ | 1.0–10.0 | 4.0 |
| Sodium Sulfite (Anhyr.) | 10–150 | 45 |
| KBr | 1.0–10.0 | 2.5 |
| 45% KOH Soln. (aq.) | 10–50 | 32 |
| Dimezone S[1] | 0.01–1.5 | 0.5 |
| BZT | 0.1–1.5 | 0.6 |
| GDL[2] | 0.5–2.5 | 1.0 |
| PMT | 0.01–0.20 | 0.1 |
| Potassium Carbonate | 10–100 | 53 |
| MBT[3] | 0.01–0.20 | 0.05 |
| DEAPD[4] | 5–50 | 20 |
| PPB[5] | 0.05–1.5 | 0.25 |
| n-butyldiethanolamine | 5–50 | 20 |
| Water to adjust pH to about 11 | 1.0 liter | |

[1]4-hydroxymethyl-4-methyl-1-phenyl-3-pyrazolidone
[2]Glucono Delta Lactone
[3]2-Mercaptobenzothiazole
[4]3-(Diethylamino)-1,2-Propanediol
[5]1-phenethyl-2-picolinium bromide

Development Accelerators

The development accelerators useful within the scope of this invention have the general formula:

$$(A-(CH_2)_m-(Y)_n-(Z)_k-(CH_2)_p-B)\ qX$$

wherein

A is

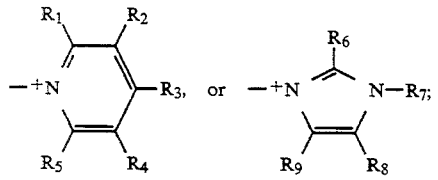

B is selected from the group consisting of A, hydrogen, phenyl, sulfonate, protonated substitued amino groups, unprotonated substituted amino groups, protonated unsubstituted amino groups, and unprotonated unsubstituted amino groups.

Y is a carbonyl containing linkage;

Z is phenyl;

m is an integer from 0 to 8;

p is an integer from 0 to 8;

k is 0 or 1;

n is 0 or 1;

with the proviso that m+n+p+k is greater than 0, and further with the proviso that when n is 1, m is greater than 0 and k+p is greater than 0;

$R_1$ through $R_9$ are independently selected from the group consisting of hydrogen, halogen, amino, saturated or unsaturated alkyl of 1 to 10 carbon atoms, wherein adjacent R groups can form a saturated or unsaturated ring;

X is a counterion; and q is an integer from 0 to 2 and is selected to balance the charge of the compound.

Carbonyl containing linkages include but are not limited to esters and amides. By carbonyl linkages, we consider ketones, ureas, urethanes, and carbonates as equivalents. Also within contemplation as equivalents are linkages containing multiple carbonyl groups wherein n is greater than 1, such as, for example, 1,2-diones, and 1,2,3-triones.

For $R_1$ through $R_9$ the amino group may be mono-, di-, or tri-substituted. For $R_1$ through $R_9$, the alkyl containing 1 to 10 carbon atoms may be saturated (e.g., methyl, ethyl, propyl, etc.), or unsaturated (e.g., vinyl, allyl, etc.). Adjacent R groups may link to form a saturated or unsaturated ring.

The anion X can be a halide anion, for example, a chloride, bromide, or iodide ion, but also a complex inorganic ion, such as alkyl sulfate or perchlorate, or a common organic ion, such as toluene sulfonate or trichloroacetate. Anions of strong acids are preferred. If the development accelerator compound contains a radical with an anion group, the anion X is optionally omitted because of the formation of an inner salt.

The development accelerators may be added to the emulsion or to the developer, and may be added as a solid or dissolved in water or some water-miscible solvent such as acetone or one of the lower alcohols. If added to the developer, the development accelerators can advantageously be added in amounts from 0.05 g to 1.5 g per liter of developer (working strength) and preferably in amounts from 0.25 g to 1.0 g per liter. If added to the emulsion, the development accelerators are preferably employed in amounts of 0.05 g to 2.0 g/unit (one unit=1.5 moles silver). It is preferred to incorporate the development accelerators into the developer.

The particularly preferred development accelerator of this invention is 1-phenethyl-2-picolinium bromide ("PPB"). Other preferred development accelerators of the invention include:

ethyl-(α-pyridinium)acetate bromide

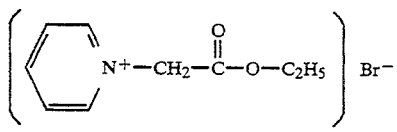

(Compound I)

1-phenethyl-4-(dimethylamino)-pyridinium bromide

-continued (Compound II)

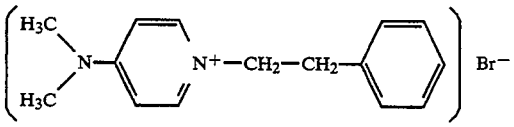

Cetyl pyridinium bromide (Compound III)

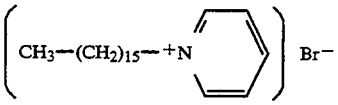

1-phenethyl-quinolinium bromide (Compound IV)

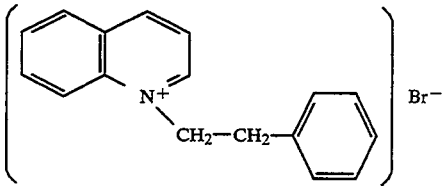

1-(N,N-dimethylacetamino)pyridinium chloride (Compound V)

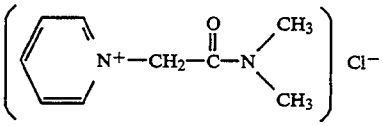

1-allyl-3-[(N,N-diethylammonium)ethyl]imidazolium chloride (Compound VI)

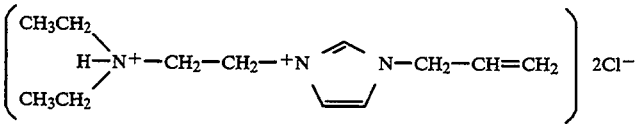

1-[(N,N-dimethylammonium)ethyl]dihydroquinoline bromide (Compound VII)

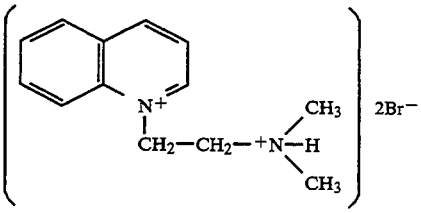

1-vinyl-3-[(N,N-diethylammonium)ethyl]imidazolium chloride (Compound VIII)

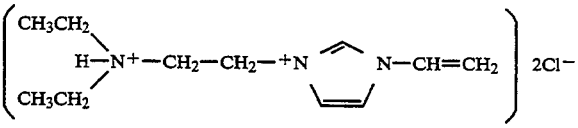

1-phenethyl-4-methyl-pyridinium bromide (Compound IX)

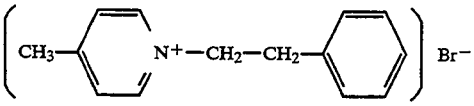

1-allyl-3(2-dimethylaminoethyl)imidazolium chloride, hydrochloride salt (Compound X0

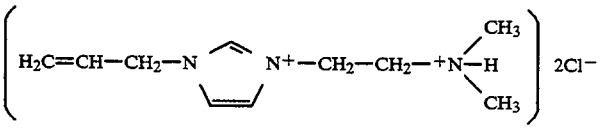

1-phenethyl-3,5-methyl-pyridinium bromide

-continued (Compound XI)

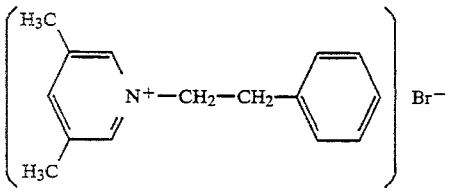

1-phenethyl-4-ethyl-pyridinium bromide (Compound XII)

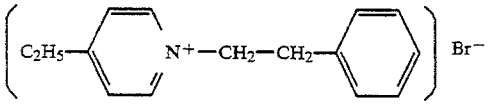

1-ethylquinolinium iodide (Compound XIII)

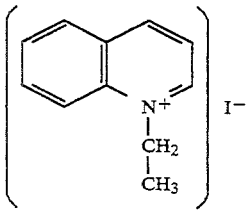

1-(3-sulfapropyl)pyridinium hydroxide, inner salt (Compound XIV)

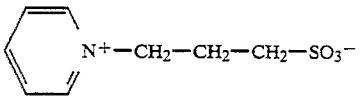

1-ethyl-2-methylpyridinium bromide (Compound XV)

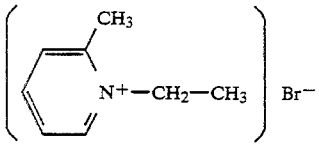

1,2 di-methylquinolinium methylsulfate (Compound XVI)

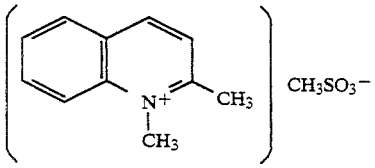

1,4-(dipyridinium)butane dibromide (Compound XVII)

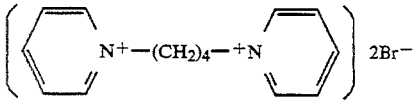

1,3-(di-2-methylpyridinium)propane dibromide (Compound XVIII)

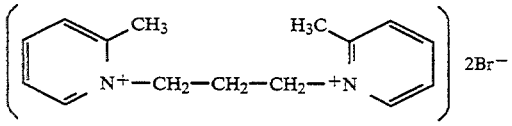

1-(2-phenethyl)isoquinolinium bromide (Compound XIX)

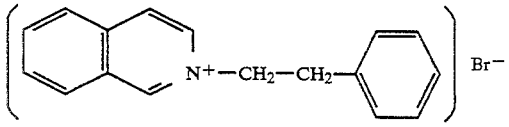

1,6-(di-2-methylpyridinium)hexane dibromide

-continued (Compound XX)

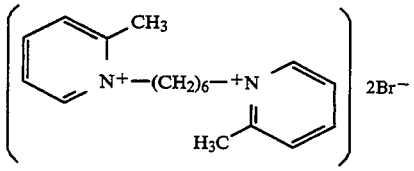

1,4-di[(2-methylpyridinium)methyl]benzene dibromide (Compound XXI)

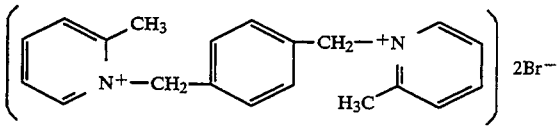

1-(N,N-diethylaminoethyl)-pyridinium chloride hydrochloride salt (Compound XXII)

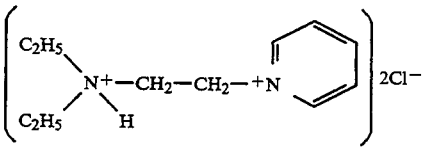

EXAMPLES

This invention will now be illustrated by the following examples of which Example 2 is considered to be the best mode.

Preparation 1: Compound XVI

To a solution of 2-methylquinoline (14.3 g, 0 mmoles) in acetone (80 mL) was added dimethyl sulfate (13.9 g, 110 mmoles) dropwise. The reaction was refluxed, cooled and the precipitate collected. The precipitate was washed with acetone and ether and dried under vacuum to give 21.2 g of the product (mp=155°-156° C.; yield=78.7%).

Preparation 2: Compound XV

To a solution of 2-picoline (9.3 g, 100 mmoles) in acetone (50 mL) was added ethyl bromide (12.0 g, 110 mmoles) dropwise. The mixture was refluxed for five days and the gummy residue was triturated with acetone and ether. The resulting white powder was dried under vacuum to give 7.6 g of the product (mp=39°-41° C.; yield=37.6%).

Preparation 3: Compound XVII

To a solution of 1,4-dibromobutane (21.59 g, 100 mmoles) in methanol (40 mL) was added pyridine (31.6 g, 400 mmoles). The mixture was refluxed for 24 hours and allowed to cool. The solid was collected, washed with ether and acetone and dried under vacuum to give 36.6 g of the product (mp=242°-243 ° C.; yield=97.9%).

Preparation 4: Compound XVIII

To a solution of 1,3-dibromopropane (20.2 g, 100 mmoles) in methanol (40 mL) was added 2-picoline (37.3 g, 400 mmoles). The mixture was refluxed for 24 hours, allowed to cool, and the solid was collected, washed with ether, and dried under vacuum to give 31.4 g of the product (top=280°-281° C.; yield=80.8%).

Preparation 5: Compound I

To a solution of 20 g (0.12 mol) of ethyl bromoacetate in 32 mL of acetone at room temperature was added dropwise 10.4 g (0.13 tool) of pyridine. The slurry was stirred for 4 hours and the product was collected by filtration, washed with ether and vacuum dried to give a quantitative yield of the product as a white solid (top=124°-126° C.).

Preparation 6: Compound II

A solution consisting of 18.5 g of (2-bromo-ethyl)benzene, 12.2 g of 4-dimethylaminopyridine and 150 mL of acetonitrile was heated at reflux for 24 hours. The solvent was removed on a rotatory evaporator and the resulting oil was triturated with diethyl ether yielding white crystals which were collected by filtration, rinsed with fresh diethyl ether and dried under nitrogen (hygroscopic) to give 28.0 g of product (top=140°-142° C.).

Preparation 7: Compound XI

A solution consisting of 18.5 g of (2-bromo-ethyl)benzene, 10.7 g of 3,5-lutidine and 150 mL of acetonitrile was heated at reflux for 24 hours. The reaction mixture was chilled to 0° C. in an ice bath and the precipitate was collected by filtration, rinsed with a small amount of fresh acetonitrile and dried under nitrogen (hygroscopic) to give 24.6 g of product (mp=230°-232° C.).

Preparation 8: Compound XII

A solution consisting of 18.5 g of (2-bromoethyl)benzene, 10.7 g of 4-ethylpyridine and 150 mL of acetonitrile was heated at reflux for 24 hours. The solvent was removed on a rotatory evaporator and the resulting oil was triturated with acetone, yielding white crystals which were collected by filtration, rinsed with fresh diethyl ether and dried under nitrogen (hygroscopic) to give 28.6 g of product (mp=109.5-111° C.).

Preparation 9: Compound VI

A solution consisting of 35.5 g of (2-dimethylamino)ethyl chloride hydrochloride, 16.35 g of 1-allylimidazole and 270 mL of acetonitrile was heated at reflux for 5 hours. The solvent was removed on a rotatory evaporator and the resulting oil was triturated with a mixture of 1:1 acetone/methylene chloride to remove unreacted starting material. The product (11.0 g; mp=110°-112.5° C.) was obtained by filtration, rinsing with fresh solvent and drying under nitrogen (hygroscopic) .

Preparation. 10: Compound VII

A solution consisting of 52.2 g of (2-diethylamino)ethyl bromide hydrobromide, 25.8 g quinoline and 300 mL of acetonitrile was heated at reflux for 18 hours. The crude product ( 49.3 g) obtained by filtration of the cold reaction mixture was recrystallized from isopropyl alcohol giving 33.3 g of pure product (hygroscopic; mp=204°-206° C.).

EXAMPLE 1

A standard control developer commonly used for the development of hydrazine containing films was prepared as follows:

| Ingredient | Amount (g/liter of working strength) |
|---|---|
| $Na_3EDTA$ | 3.87 |
| Sodium Bisulfite | 62 |
| Hydroquinone | 25 |
| Metol[1] | 1.5 |
| KBr | 3.0 |
| DEAPD | 24.23 |
| BZT | 0.50 |
| PMT | 0.05 |
| GDL | 1.0 |
| 45% KOH Soln. (Aq) | 105.6 |
| Potassium Carbonate (anhy.) | 53 |
| Water to make | 1 liter |
| Adiust PH to 11.0 | |

[1]N-Methyl-p-aminophenol sulfate

This solution was placed in a tray and numerous sheets of exposed, standard, hydrazine-containing films, e.g., Quanta-One TM Camera ("QOC") films (E. I. du Pont de Nemours and Company, Wilmington, DE), were processed therein at 35° C. (95° F.) until the activity was considered to be unacceptable. At that point, 1 g/liter of 1-phenethyl-2-picolinium bromide (PPB) was added to the tray and additional sheets of exposed film processed therein. Full activity was noted.

EXAMPLE 2

A developer similar to that described in Example 1, but containing an ascorbate in place of the hydroquinone, was prepared. This developer had the following composition:

| Ingredient | Amount (g) |
|---|---|
| $Na_3EDTA$ | 4 |
| Sodium sulfite (anhyrd.) | 30 |
| Sodium L-ascorbate | 56 |
| KBr | 4 |
| BZT | 0.5 |
| Dimezone-S | 0.5 |
| GDL | 0.05 |
| 45% Aq. KOH | 25 |
| 47% Aq. $K_2CO_3$ | 112 |
| PMT | 0.5 |

These ingredients were diluted to 1 liter with distilled water and the pH adjusted to 11.0. Samples of QOC film were exposed and processed in trays containing this developer at 35° C. (95° F.) until the activity decreased indicating that the developer was exhausted.

Two portions of this exhausted developer were then taken and PPB (0.25 g/liter and 0.05 g/liter) added thereto. Film samples processed in this new developer showed renewed activity even at the lowest level of PPB. Thus, the addition of PPB is shown to increase the developer activity which is a long sought after goal.

EXAMPLES 3-10

Example 2 was repeated with the exception that PPB was replaced with the various development accelerator compounds listed below.

| Example | Compound | Amount (g/l) |
|---|---|---|
| 3 | I | 0.6 |
| 4 | II | 0.2 |
| 5 | III | 0.1 |
| 6 | IV | 0.2 |
| 7 | V | 0.2 |
| 8 | VI | 0.6 |
| 9 | VII | 0.5 |
| 10 | VIII | 0.4 |

All of these compounds increased the activity of exhausted developer and all gave acceptable pepper values.

EXAMPLES 1-15

The following Examples and Comparative Examples illustrate the embodiment of the present invention wherein the development accelerators are incorporated into a hydrazine-containing silver halide emulsion.

Coatings were prepared of camera negative emulsions described in detail in Ruger, U.S. Pat. No. 4,937,160 with experimental formulation variations as described below. The emulsion was comprised of monodispersed grains of composition 98 mole % bromide and 2 mole % iodide dispersed in 80 grams of gelatin per unit of silver. This emulsion was sensitized with sulfur and gold sensitizers and digested for 75 minutes at 53.8° C. (129 ° F.). The emulsion contained 0.28 g/unit of green sensitizing dye KF 508 (a proprietary dye of Reidel de Haen) added as a solution in 1:1 acetone/ethanol. The emulsion also contained, as antifoggants, benzotriazole (0.42 g/unit) in ethanol solution and 5-nitroindazole (0.02 g/unit) in acetone/water solution. The emulsion contained a hydrazine, BOP-HMP, in 240 mg/unit added as a methanol solution. Other stabilizers, coating aids, hardeners, and other adjuvants were added as well known to those skilled in the art. The emulsion was split into portions and development accelerator compounds were added to the emulsion portions as described in Table 1. Compound XXII and PPB were added as aqueous solutions.

The thus prepared emulsions were coated on 4 mil polyethylene terephthalate Cronar ® base (E.I. du Pont de Nemours and Company) having the normal resin and gel sub-layers at a silver coating weight of 4.7 g $Ag/m^2$. A thin layer of gelatin (9 $mg/dm^2$) was coated over each emulsion layer as an anti-abrasion overcoat.

The coated and dried films were exposed on a D.S. America Camera, to a continuous and halftone target (through a Beta GNE-MR screen) for 20 seconds. The exposed films were tray developed in Quanta-One$^{TM}$ Hybrid developer at 35° C. (95 ° F.) for 30 seconds. A 5% acetic acid shortstop, DuPont DLF fixer and water wash were used in completion of the processing steps in the normal manner of tray processing. Sensitometry was computed in the usual manner from sensitometric test images and B+F (base plus fog) contrast measured as main Gradient (1) between 0.4 and 1.5 densities and "toe" Gradient (2) between 0.1 and 0.4 densities and relative photographic speed (at density 2.5) compared between coatings. For each example, the speed reported is a percentage relative to the speed of the control, which was taken to be 100. The sensitometric results of the coatings are presented in Table 1.

TABLE 1

| Example | Development Accelerator Compound | Development Accelerator Amount | B + F | Speed | Sensitometric Effect Gradient (1) | Sensitometric Effect Gradient (2) |
|---|---|---|---|---|---|---|
| Control | — | — | 0.04 | 100 | 13.6 | 6.7 |
| 11 | PPB | 0.25 | 0.04 | 121 | 14.8 | 7.5 |
| 12 | PPB | 0.50 | 0.04 | 130 | 18.9 | 9.2 |
| 13 | PPB | 1.00 | 0.04 | 139 | 22.2 | 9.7 |
| 14 | PPB | 2.00 | 0.05 | 119 | 18.0 | 8.2 |
| 15 | XXII | 1.0 | 0.04 | 118 | 20.1 | 8.1 |

These results indicate a relationship between PPB concentration and speed and contrast, particularly at shorter development times, whereby an increase in PPB (at constant hydrazine concentration) results in an increase in speed and contrast. These effects are very clear in the above Table at PPB concentrations from 0.25–1.0 g/L. At greater concentrations, B+F and pepper, which was observed visually with a 50× magnifier, began to increase and resulted in apparent loss of speed and contrast. We say "apparent loss of speed and contrast" because, in fact, the background non-image areas and very low density region of the characteristic H&D curve was affected, which resulted in lower speed and contrast values. The rate-of-development effects were seen primarily in the increase in "toe" contrast, represented by Gradient (2), which strongly affected dot quality. The higher Gradient (2) values at shorter development times with the accelerators nearly equals the "toe" contrast of coatings without a development accelerator at longer development times. This effect was seen as much better dot quality (observed visually with a 50× magnifier) in films containing the development accelerators, especially at the shorter development times.

These data also shows the effect of different development accelerators with the same hydrazine. Compound XXII shows the same sensitometric effect as PPB, but was tested at only one concentration/coating. Again, the effect was greatest at shorter development times where "toe" contrast was high resulting in good dot quality as observed visually with a 50× magnifier.

EXAMPLES 16–33

Coatings were prepared of a photoelectronic emulsion. The emulsion was comprised of monodispersed grains of composition 80 mole % Cl, 19.5 mole % bromide and 0.5 mole % iodide dispersed in 80 g per unit of gelatin. This emulsion was sensitized with gold and sulfur sensitizers and digested for 56 minutes at 55° C. (131° F.). The emulsion also contained 180 mg/unit of commercially available blue sensitizing dyes. The emulsion contained BOP-HMP at 25 mg/unit added to the emulsion just prior to coating as a methanol solution. The developer accelerator compounds were added as aqueous solutions to the emulsion just prior to coating at a concentration of 0.5 g/unit unless otherwise noted.

The thus prepared emulsions were coated on 4 mil polyethylene terephthtelate Cronar® base having normal resin and gel sublayers at a silver coating weight of 4.5 g Ag/m$^2$. A thin layer of gelatin was coated over each emulsion layer as an anti-abrasion overcoat.

The coated and dried films were exposed on a D.S. America Camera, to a continuous and halftone target (through a Beta GNE-MR screen) for 40 seconds. Processing was in Quanta-One® Hybrid developer in a D.S. America Model LD-281Q processor with a development time of 35 seconds at 37.8° C. (100° F.). Sensitometry was computed in the usual manner from sensitometric test images and B+F, contrast measured as Gradient (3) between 3.5 and 0.4 densities. Photographic speed was measured at a density of 2.5 and is expressed as a percentage relative to the control being taken as 100. D.Q. is the dot quality determined by visual inspection of dots with a 50× magnifier. A scale of 1 to 5 was used with 5 being the best and a D.Q. of 3 and higher is acceptable for practical use. Pepper was determined by visual inspection on a scale of 1 to 5, with 5 being the best. A pepper value of 3 or higher is acceptable for practical use. The sensitiometric results of the coatings are presented in Table 2.

TABLE 2

| Example | Development Accelerator Compound | Development Accelerator Amount (g/Unit) | B + F | Sensitometric Effect Speed | Sensitometric Effect Gradient (3) | Sensitometric Effect D.O. | Sensitometric Effect Pepper |
|---|---|---|---|---|---|---|---|
| Control | — | — | 0.04 | 100 | 6.5 | 3 | 5 |
| 16 | PPB | 0.25 | 0.04 | 87.7 | 5.9 | 4 | 5 |
| 17 | PPB | 0.50 | 0.04 | 128 | 8.6 | 5 | 5 |
| 18 | PPB | 1.00 | 0.04 | 149 | 8.5 | 5 | 4 |
| 19 | PPB | 1.50 | 0.05 | 129 | 7.3 | 5 | 3 |
| 20 | IX | 0.50 | 0.04 | 123 | 6.0 | 4 | 5 |
| 21 | X | 0.50 | 0.04 | 108 | 6.5 | 4 | 5 |
| 22 | XI | 0.50 | 0.04 | 127 | 6.9 | 5 | 5 |
| 23 | XII | 0.50 | 0.04 | 123 | 6.4 | 5 | 5 |
| 24 | II | 0.50 | 0.04 | 119 | 6.2 | 4 | 5 |
| 25 | XIII | 0.50 | 0.04 | 123 | 7.5 | 5 | 4 |
| 26 | XIV | 0.50 | 0.04 | 115 | 8.4 | 5 | 4 |
| 27 | XV | 0.50 | 0.04 | 108 | 6.7 | 4 | 5 |
| 28 | XVI | 0.50 | 0.04 | 115 | 8.1 | 5 | 4 |
| 29 | XVII | 0.50 | 0.04 | 127 | 6.7 | 4 | 5 |
| 30 | XVIII | 0.50 | 0.04 | 139 | 7.3 | 5 | 4 |
| 31 | XIX | 0.50 | 0.04 | 146 | 13.8 | 5 | 5 |
| 32 | XX | 0.50 | 0.04 | 142 | 8.8 | 5 | 4 |
| 33 | XXI | 0.50 | 0.05 | 127 | 6.4 | 4 | 5 |

From Table 2 the effects of the development accelerators can be seen in that both speed, gradient (contrast) and dot quality are improved for the films containing both hydrazine and the development accelerators vs. hydrazine alone (Control). In Examples 16–19 with a concentration series of PPB from 0.25–1.5 g/unit, the speed and contrast increased with level of PPB. At the higher concentrations, however, pepper also increased, limiting the advantage of high levels of accelerator on overall image quality. In a variety of other types of development accelerators represented by the Examples of Table 2, similar advantages in sensitometric performance vs. the Control film are demonstrated.

EXAMPLES 34–37

The following Examples illustrate the development acceleration effect of silver halide elements which do not contain a hydrazine compound in rapid access processing when the development accelerators are included with the developer.

Developer solutions A and B were prepared having the compositions set forth in Table 3. A development accelerator compound, PPB, was added to Developer A. A commercially available hydroquinone developer, CUFD, sold by E. I. du Pont de Nemours and Company, was made to working strength and included in the test as a comparative example.

TABLE 3

| Ingredient | Developer A (g/liter) | Developer B (g/liter) |
|---|---|---|
| $Na_3EDTA$ | 3.5 | 3.5 |
| $NaHSO_3$ | 52 | 52 |
| KBr | 8 | 8 |
| GDL | 0.7 | 0.7 |
| BZT | 0.25 | 0.25 |
| Erythorbic acid | 40 | 40 |
| Dimezone -S | 0.5 | 0.5 |
| PMT | 0.05 | 0.05 |
| PPB | 0.3 | 0 |
| Water | to make 1 liter | to make 1 liter |
| pH | 10.7 | 10.7 |

Various commercially available silver halide films made by DuPont which do not contain a hydrazine were tested in each of the developer solutions. The films tested were CSB (scanner film), CHC (imagesetting film), CPR (positive camera film), and CCF (negative camera film). For each developer, each of the films were exposed to a square root of 2 wedge and tray processed at 37.8° C. (100° F.) for 25 seconds development, fixed in DLF fixer solution and washed. Sensitometry was computed in the usual manner from sensitometric test images and minimum and maximum densities, gradient (between 1.0 and 3.0 densities), and relative photographic speed (at a density of 3.50) measured as a percentage relative to the speed of the film in Developer B based on 100. The sensitometric results are presented in Table 4.

TABLE 4

| Example | Film Type | Developer | Speed | Gradient | Dmax | Dmin |
|---|---|---|---|---|---|---|
| 34 | CCF | A | 140 | 3.16 | 5.37 | 0.09 |
| Comp. Ex. 34A | | B | 100 | 2.98 | 5.26 | 0.09 |
| Comp. Ex. 34B | | CUFD | 55 | 2.75 | 5.30 | 0.08 |
| 35 | CHC | A | 160 | 3.46 | 5.58 | 0.04 |
| Comp. Ex. 35A | | B | 100 | 3.88 | 4.92 | 0.03 |
| Comp. Ex. 35B | | CUFD | 123 | 3.62 | 5.19 | 0.05 |
| 36 | CPR | A | 103 | 3.64 | 4.46 | 0.04 |
| Comp. Ex. 36A | | B | 100 | 3.44 | 4.33 | 0.03 |
| Comp. Ex. 36B | | CUFD | 106 | 3.47 | 4.23 | 0.04 |
| 37 | CSB | A | 148 | 6.08 | 5.98 | 0.04 |
| Comp. Ex. 37A | | B | 100 | 5.03 | 6.01 | 0.04 |
| Comp Ex. 37B | | CUFD | 132 | 5.89 | 6.07 | 0.04 |

The presence of PPB in developer A shows the development acceleration effect for non-hydrazine containing silver halide films compared to the films tested in Developer B. The increase speed of the CPR film in Developer A compared to Developer B is not considered statistically significant due to the variablity of tray testing.

What is claimed is:

1. A process for developing exposed negative silver halide photographic elements comprising developing said elements in a photographic developer comprising at least one developing agent selected from the group consisting of (a) ascorbic acid, (b) ascorbic acid derivatives, (c) alkali salts of (a) and (b), and (d) mixtures of (a) through (c);

for a development time less than 1 minute, in the presence of a development accelerator having the general formula:

$$[A—(CH_2)_m—(Y)_n—(Z)_k—(CH_2)_p—B,\ qX]$$

$$(A—(CH_2)_m—(Y)_n—(Z)_k—(CH_2)_p—B)\ qX$$

wherein A is

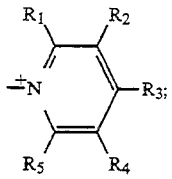

B is selected from the group consisting of A, hydrogen, phenyl, sulfonate, protonated substituted amino groups, unprotonated substituted amino groups, protonated unsubstituted amino groups, and unprotonated unsubstituted amino groups;

Y is a carbonyl or an ester group;

Z is phenylene;

m is an integer from 0 to 8;

p is an integer from 0 to 8;

k is 0 or 1;

n is 0 or 1;

with the proviso that m+n+p+k is greater than 0, and further with the proviso that when n is 1, m +p is greater than 0;

$R_1$ through $R_5$ [$R_9$] are independently selected from the group consisting of hydrogen, halogen, amino, saturated alky containing 1 to 10 carbon atoms and unsaturated alkyl containing 1 to 10 carbon atoms, wherein adjacent R groups can form a saturated or unsaturated ring;

X is a counterion; and q is an integer from 0 to 2 and is selected to balance the charge of the development accelerator.

2. The process of claim 1, wherein the development accelerator is selected from the group consisting of 1-phenethyl-2-picolinium bromide, ethyl-(alpha-pyridinium) acetate bromide; 1-phenethyl-4-(dimethylamino) -pyridinium bromide; cetyl pyridinium bromide; 1-phenethyl-quinolinium bromide; 1-(N,N-dimethylacetamido)pyridinium chloride; 1-[(N,N-dimethylammonium) ethyl]dihydroquinoline bromide; 1-phenethyl-4 -methyl-pyridinium bromide; 1-phenethyl-3,5-methyl-pyridinium bromide; 1 -phenethyl-4 -ethyl-pyridinium bromide; 1-ethylquinolinium iodide; 1- (3-sulfapropyl) pyridinium hydroxide, inner salt; 1-ethyl-2-methylpyridinium bromide; 1,2dimethylquinolinium methylsulfate; 1,4-(dipyridinium) butane dibromide; 1,3-(di-2-methyl-pyridinium)propane propane dibromide; 1-(2-phenethyl) iso-quinolinium bromide; 1,6- (di-2-methylpyridinium) hexane dibromide; 1,4-di benzene dibromide; and 1-(N,N-diethylaminoethyl) -pyridinium chloride hydrochloride salt.

3. The process of claim 1 or 2, wherein the development accelerator is present in said photographic element.

4. The process of claim 3 wherein the development accelerator is present in the range of 0.05 g to 2.0 g/unit of silver halide wherein one unit equals 1.5 moles silver.

5. The process of claim 1 or 2, wherein the development accelerator is present in said developer.

6. The process of claim 5, wherein the development accelerator is present in the range of 0.05 g to 1.5 g/L of developer.

7. The process of claim 1, wherein said at least one developing agent is a mixture of L-ascorbic acid and sodium ascorbate.

8. The process of claim 1, wherein the silver halide element contains a hydrazine.

9. A process for developing exposed silver halide photographic elements which comprise a silver halide emulsion whose silver halide consists of a halide content of 80 mole % Cl, 19.5 mole % Br, and 0.5 mole % I and whose silver halide emulsion contains 2-(4-benzyloxy-phenyl)-1-pyridinium acetyl-hydrazine bromide, the process comprising developing said elements in a photographic developer comprising at least one developing agent in the presence of a development accelerator having the general formula:

$$(A—(CH_2)_m—(Y)_n—(Z)_k—(CH_2)_p—B)\ qX$$

wherein

A is

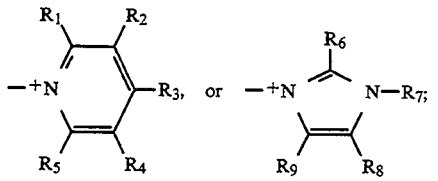

B is selected from the group consisting of A, hydrogen, phenyl, sulfonate, protonated substituted amino groups, unprotonated substituted amino groups, protonated unsubstituted amino groups, and unprotonated unsubstituted amino groups;

Y is a carbonyl or an ester group;

Z is phenylene;

m is an integer from 0 to 8;

p is an integer from 0 to 8;

k is 0 or 1;

n is 0 or 1;

with the proviso that m+n+p+k is greater than 0, and further with the proviso that when n is 1, m +p is greater than 0;

$R_1$ through $R_9$ are independently selected from the group consisting of hydrogen,. halogen, amino, saturated alkyl containing 1 to 10 carbon atoms, and unsaturated alkyl containing 1 to 10 carbon atoms, wherein adjacent R groups can form a saturated or unsaturated ring;

X is a counterion; and q is an integer from 0 to 2 and is selected to balance the charge of the development accelerator.

10. The process of claim 8, wherein said silver halide element comprises an emulsion comprising silver bromoiodide grains, wherein the iodide content comprises 0 to 2 mol % and contains 2-(4-benzyl-oxyphenyl)-1-pyridinium acetyl)-hydrazine bromide.

11. The process of claim 8, wherein said silver halide element comprises an emulsion comprising at least 90mol % chloride grains doped with at least 10-6 mole rhodium per mole silver and contains a chloride or bromide salt of 1-imidazolium.

12. A process for developing exposed negative silver halide photographic elements comprising developing said elements in a photographic developer comprising at least one developing agent selected from the group consisting of (a) ascorbic acid, (b) ascorbic acid derivatives, (c) alkali salts of (a) and (b), and (d) mixtures of (a) and (c), and wherein said developer further comprises 5-50 g/liter of an alkanol amine;

for a development time of less than one minute, in the presence of a development accelerator having the general formula:

$$(A—(CH_2)_m—(Y)_n—(Z)_k—(CH_2)_p—B)\ qX$$

wherein

A is

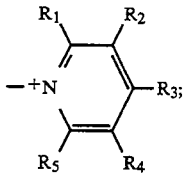

B is selected from the group consisting of A, hydrogen, phenyl, sulfonate, protonated substituted amino groups, unprotonated substituted amino groups, protonated unsubstituted amino groups, and unprotonated unsubstituted amino groups;

Y is a carbonyl or an ester group;

Z is phenylene;

m is an integer from 0 to 8;

p is an integer from 0 to 8;

k is 0or 1;

n is 0or 1;

with the proviso that m+n+p+k is greater than 0, and further with the proviso that when n is 1, m +p is greater than 0;

$R_1$ through $R_5$ are independently selected from the group consisting of hydrogen, halogen, amino, saturated alkyl containing 1 to 10 carbon atoms and unsaturated alkyl containing 1 to 10 carbon atoms, wherein adjacent R groups can form a saturated or unsaturated ring;

X is a counterion; and q is an integer from 0 to 2 and is selected to balance the charge of the development accelerator.

13. The process of claim 12, wherein said alkanol amine is n-butyldiethanolamine.

14. The process of claim 1 or 2, wherein said developer comprises:

| Ingredient | Amount (g) |
|---|---|
| Sodium Erythorbate | 10-150 |
| Trisodium Ethylenediamine-tetraacetic acid | 1.0-10.0 |
| Sodium Sulfite (Anhyr.) | 10-150 |
| Potassium Bromide | 1.0-10.0 |
| 45% KOH Soln. (aq.) | 10-50 |
| 4-Hydromethyl-4-Methyl-1-Phenyl-3-Pyrazolidone | 0.01-1.5 |
| Benzotriazole | 0.1-1.5 |
| Glucono Delta Lactone | 0.5-2.5 |
| 1-Phenyl-5-Mercaptotetrazole | 0.01-0.20 |
| Potassium Carbonate | 10-100 |
| 2-Mercaptobenzothiazole | 0.01-20 |
| 3-(Diethylamino)-1,2-Propanediol | 5-50 |
| 1-Phenethyl-2-Picolinium-Bromide | 0.05-1.5 |
| n-butyldiethanolamine | 5-50 |

-continued

| Ingredient | Amount (g) |
|---|---|
| Water to | 1 liter |

15. A process for developing exposed silver halide photographic elements which comprise a silver halide emulsion whose silver halide consists of a halide content of 80 mole % Cl, 19.5 mole % Br, and 0.5 mole % I and whose silver halide emulsion contains 2-(4-benzyloxyphenyl)-l-pyridinium acetyl-hydrazine bromide, the process comprising developing said elements in a photographic developer comprising at least one developing agent in the presence of a development accelerator selected from the group consisting of 1-phenethyl-2-picolinium bromide, ethyl- (alpha-pyridinium) acetate bromide; 1-phenethyl-4-(dimethylamino)-pyridinium bromide; cetyl pyridinium bromide; 1-phenethylquinolinium bromide; 1-(N,N-dimethylacetamido)-pyridinium chloride; 1-allyl-3-((N,N-diethylammonium) ethyl) imidazolium chloride; 1-((N,N-dimethylammonium) ethyl ) dihydroquinoline bromide; 1-vinyl3((N,N-diethylammonium) ethyl) imidazolium chloride; 1-phenethyl-4-methyl-pyridinium bromide; 1-allyl-3 (2dimethylaminoethyl) imidazolium chloride, hydrochloride salt; 1-phenethyl-3,5-dimethylpyridinium bromide; 1-phenethyl-4-ethylpyridinium bromide; 1-ethylquinolinium iodide; 1-(3-sulfapropyl)-pyridinium hydroxide, inner salt; 1-ethyl-2-methylpyridinium bromide; 1,2-dimethylquinolinium methylsulfate; 1,4-(dipyridinium) butane dibromide; 1,3- (di-2-methylpyridinium) propane dibromide; 1- (2-phenethyl) isoquinolinium bromide; 1,6-(di-2-methylpyridinium) hexane dibromide; 1-(4-(1-(2-methylpyridinium)methyl))benzyl-2-methylpyridinium dibromide; and 1-(N,N-diethylaminoethyl)-pyridinium chloride hydrochloride salt.

* * * * *